US010997945B2

(12) United States Patent
Chen

(10) Patent No.: US 10,997,945 B2
(45) Date of Patent: May 4, 2021

(54) DISPLAY PANEL AND DRIVING DEVICE FOR THE SAME

(71) Applicant: BOE TECHNOLOGY GROUP CO., LTD., Beijing (CN)

(72) Inventor: Yi Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/696,862

(22) Filed: Nov. 26, 2019

(65) Prior Publication Data

US 2020/0251068 A1 Aug. 6, 2020

(30) Foreign Application Priority Data

Jan. 31, 2019 (CN) ..... 201910096805.3

(51) Int. Cl.
*G09G 5/00* (2006.01)
*G09G 3/3258* (2016.01)
*G09G 3/3275* (2016.01)

(52) U.S. Cl.
CPC ..... *G09G 5/008* (2013.01); *G09G 3/3258* (2013.01); *G09G 3/3275* (2013.01); *G09G 2300/0809* (2013.01); *G09G 2310/027* (2013.01); *G09G 2310/0291* (2013.01)

(58) Field of Classification Search
None
See application file for complete search history.

(56) References Cited

U.S. PATENT DOCUMENTS

2015/0103038 A1 4/2015 Han et al.
2015/0179102 A1 6/2015 Kim et al.
2015/0220383 A1 8/2015 Saito
2016/0189595 A1 6/2016 Choi et al.
2018/0006101 A1* 1/2018 Ha ..... H01L 27/32

FOREIGN PATENT DOCUMENTS

CN 104732918 A 6/2015
CN 105741728 A 7/2016
CN 107393503 A 11/2017
CN 107564464 A 1/2018
JP 2015-144391 A 8/2015

OTHER PUBLICATIONS

First Office Action and English language translation, CN Application No. 201910096805.3, dated Feb. 3, 2020, 17 pp.

* cited by examiner

*Primary Examiner* — Aneeta Yodichkas
(74) *Attorney, Agent, or Firm* — Myers Bigel, P.A.

(57) ABSTRACT

A display panel and a driving device for the same are disclosed. The driving device includes a timing controller and a source driver IC. The timing controller includes a first interface, a first transmitter and a first receiver which are connected with the first interface, and a first data selector which is configured to control the first transmitter and the first receiver. The source driver IC includes a second interface which is connected with the first interface, a second transmitter and a second receiver which are connected with the second interface, and a second data selector which is configured to control the second transmitter and the second receiver. The first data selector and the second data selector are configured to control the first transmitter to communicate with the second receiver in a first period, and to control the second transmitter to communicate with the first receiver in a second period.

6 Claims, 2 Drawing Sheets

DISPLAY PANEL AND DRIVING DEVICE FOR THE SAME

RELATED APPLICATIONS

The present application claims the benefit of Chinese Patent Application No. 201910096805.3, filed Jan. 31, 2019, the entire disclosure of which is incorporated herein by reference.

TECHNICAL FIELD

The present disclosure relates to the field of display technologies, and particularly to a driving device for a display panel and a display panel comprising the driving device.

BACKGROUND

An active matrix organic light emitting display comprises OLEDs (organic light-emitting diodes) which can emit light by themselves. In each pixel, a driving current for each OLED can be controlled by a driving TFT (thin film transistor), and brightness of the OLED can thus be controlled. In practice, electrical characteristics of the driving TFTs in the pixels vary from one to another due to process conditions, driving environment, or the like. For these reasons, a data voltage generates different driving currents in the pixels. In this way, brightness deviation is caused among pixels. In an external compensation technique, characteristic parameters of driving TFTs in each pixel are sensed, and the input data is correctly rectified based on the sensed result to reduce the brightness difference among pixels.

SUMMARY

In a first aspect, embodiments of the present disclosure provide a driving device for a display panel, comprising a timing controller and a source driver IC, wherein the timing controller comprises a first interface, a first transmitter and a first receiver which are connected with the first interface, and a first data selector which is configured to control the first transmitter and the first receiver, wherein the source driver IC comprises a second interface which is connected with the first interface, a second transmitter and a second receiver which are connected with the second interface, and a second data selector which is configured to control the second transmitter and the second receiver, and wherein the first data selector and the second data selector are configured to control the first transmitter to communicate with the second receiver in a first period, and to control the second transmitter to communicate with the first receiver in a second period.

The driving device for a display panel according to the above embodiments of the present disclosure can further comprise the following additional technical features.

According to embodiments of the present disclosure, the first transmitter of the timing controller is configured to send control data to the second receiver of the source driver IC in the first period, and the second transmitter of the source driver IC is configured to send the sensed data to the first receiver of the timing controller in the second period.

According to embodiments of the present disclosure, the first interface and the second interface are a peer-to-peer (P2P) interface.

According to embodiments of the present disclosure, the source driver IC further comprises: a sensor which is configured to sense a sensed voltage value in a sense line of the display panel; an analog-to-digital converter which is connected with the sensor and configured to convert the sensed voltage value into a sensed voltage digital value; and an encoder which is connected between the second transmitter and the analog-to-digital converter, and configured to encode the sensed voltage digital value.

According to embodiments of the present disclosure, the control data comprises video data, a control signal, and a clock recovery signal.

According to embodiments of the present disclosure, the source driver IC further comprises: a clock and data recovery circuit which is connected with the second receiver, and configured to extract the video data, the control signal and the clock recovery signal from the control data.

In some embodiments, the source driver IC further comprises a latch which is connected with the clock and data recovery circuit, and configured to cache the video data and drive the display panel according to the video data.

In some embodiments, the source driver IC further comprises a digital-to-analog converter which is connected with the clock and data recovery circuit, and configured to convert the control signal into analog control signal; and an amplifier which is connected with the digital-to-analog converter, and configured to amplify the analog control signal.

According to embodiments of the present disclosure, the display panel comprises organic light-emitting diodes.

According to embodiments of the present disclosure, the first period is a display period of the display panel, and the second period is a non-display period.

According to embodiments of the present disclosure, the source driver IC further comprises an oscillator, and the oscillator and the clock and data recovery circuit form a clock management title, which is configured to provide a clock source to the sensor, the analog-to-digital converter and the encoder.

According to embodiments of the present disclosure, the source driver IC further comprises a data selection controller, which is connected with the clock and data recovery circuit, and configured to receive the control signal to control the second data selector, the second transmitter, and the second receiver.

In a second aspect, embodiments of the present disclosure provide a display panel which comprises the driving device as described above.

BRIEF DESCRIPTION OF THE DRAWINGS

In order to explain the above and/or additional aspects and advantages of the present disclosure more clearly, the drawings to be used in the description of the embodiments will be introduced briefly in the following.

DETAILED DESCRIPTION OF EMBODIMENTS

Figure 1:
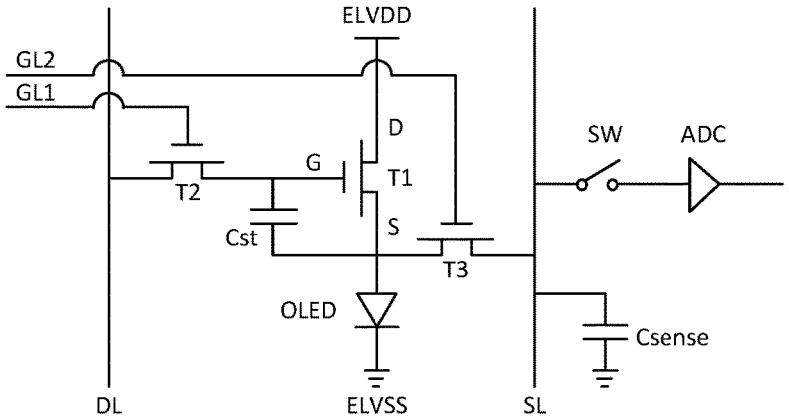
Prior Art Fig. 1
FIG. 1 is a circuit diagram for a basic pixel compensation circuit in an OLED in the related art.

To make the objects, the technical solutions and the advantages of embodiments of the present disclosure more apparent, the technical solutions of the embodiments of the present disclosure will be described in detail hereinafter in conjunction with the drawings of the embodiments of the present disclosure.

Currently, in a sensing method for extracting variation in a threshold voltage Vth of a driving TFT, a source voltage of the driving TFT is detected as the sensed voltage, and the variation of the threshold voltage Vth of the driving TFT is detected based on the sensed voltage. In a method for extracting the mobility of the driving TFT, a driving voltage is applied to a gate of the driving TFT. The mobility is determined according to a charging voltage of a sense line SL. The threshold voltage Vth drifts during light emission of the OLED, and drifting of the threshold voltage Vth causes deviation in the charging voltage of the sense line SL (and thus the mobility). Therefore, there is a need for a device and method for detecting the threshold voltage Vth in real-time to provide correct compensation. During real-time compensation by using the driving device in the related art, a timing controller TCON transmits the display data to a source driver IC through a P2P (Peer-to-Peer) transmission protocol, and the source driver IC transmits the sensed data back to the timing controller TCON through a MLVDS (multi-point low voltage differential signal) transmission protocol. However, this kind of driving device has a complicated design, low degree of system integration, poor stability, and high cost.

A driving device for a display panel and a display panel comprising the driving device according to embodiments of the present disclosure will be described hereinafter with reference to the accompanying drawings.

An OLED display device generally comprises a display panel, a timing controller, a source driver IC, and a gate driver. The timing controller receives the RGB data and the timing control signal TC (Timing Control) from external inputs, and meanwhile receives the sensed data output by the source driver IC. After being subject to algorithms such as calculation, conversion, and compensation, during operation of the OLED display device, the data and the source control signal SCS (Source Control Signal) generated by the timing controller are output to the source driver IC, and the gate control signal GCS (Gate Control Signal) generated by the timing controller is output to the gate driver.

Upon receipt of the data and the source control signal SCS, the source driver IC generates corresponding data voltages, and the data voltages are output to the display panel through data lines DL. Upon receipt of the gate control signal GCS, the gate driver generates corresponding driving signals, and the driving signals are output to the display panel through scan lines GL. Under control of the source driver IC and the gate driver, the source driver IC senses optical/electrical characteristic values of pixels through sense lines SL, and the source driver IC generates corresponding the sensed data which are output to the timing controller.

As shown in FIG. 1, the display panel comprises a plurality of pixels, and reference is made to a case in which pixels are compensated externally by a 3T1C circuit. Each pixel comprises one data line DL, one sense line SL, two scan lines GL1 and GL2, one organic light-emitting diode (OLED) device, one store capacitor Cst, one driving TFT T1, one scan TFT T2, and one sense TFT T3.

In particular, the scan TFT T2 and the sense TFT T3 are turned on, to provide a constant voltage Vdata the data line DL, and to provide a reset voltage Vref the sense line SL. In case Vdata of the driving TFT T1 is larger than Vref, i.e., Vdata>Vref, the driving TFT T1 generates a current, to charge a capacitor Csense. For example, the capacitor Csense is charged by a constant duration. The scan TFT T2 and the sense TFT T3 are turned off, and a switch (transistor) SW is turned on, a voltage on the capacitor Csense is sampled with an analog-to-digital converter ADC and is converted into a digital binary value. In case I-V characteristics (current-voltage characteristics) of the driving TFT T1 are different, voltages on the capacitor Csense are also different. The I-V (current-voltage) characteristics of the driving TFT T1 can be indicated by voltage values of Csense. Difference in I-V characteristics of the driving TFT T1 are primarily reflected by the threshold voltage Vth and the mobility μ, wherein $i=\mu(Vdata-Vth-Vref)^2$.

Figure 2:
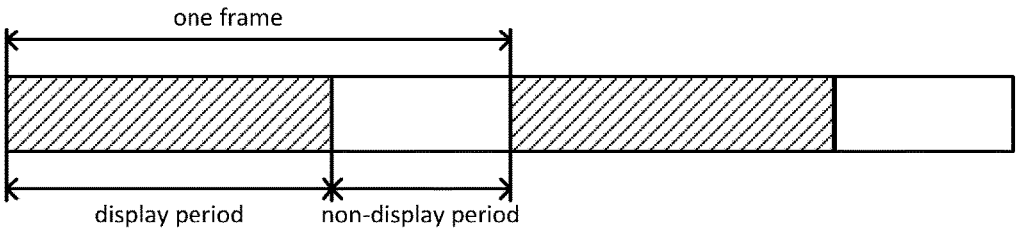
Prior Art Fig. 2
FIG. 2 is a view for a display period and a non-display period in the related art.

As shown in FIG. 2, in the display period of each frame, the timing controller transmits video signal to the source driver IC through a high speed serial P2P interface, and in the non-display period (i.e., a blank duration in which the display voltage is absent) of each frame, real-time compensation is performed, and the sensed data is sent back to the timing controller.

Figure 3:
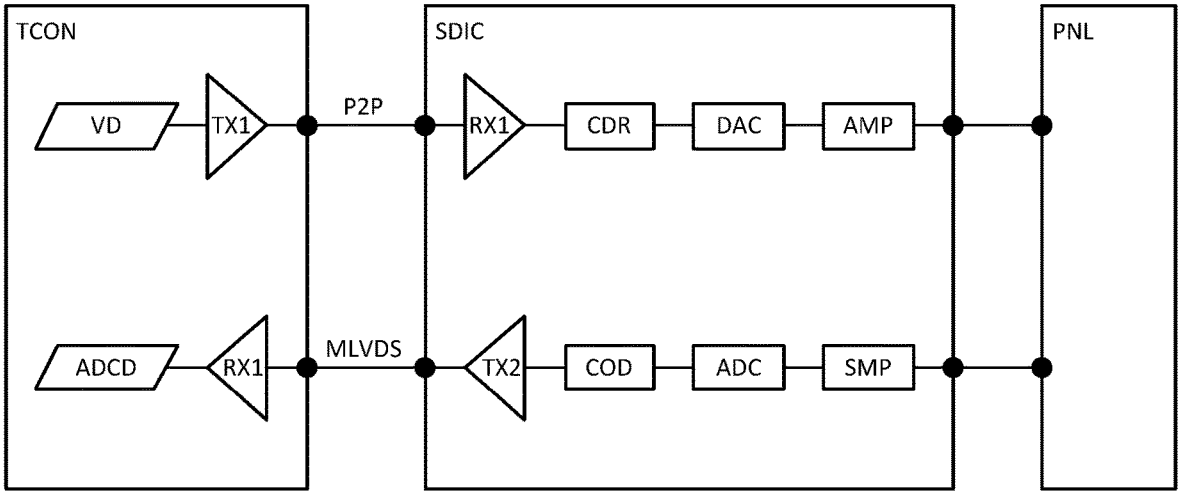
Prior Art Fig. 3
FIG. 3 is a view for transmission of the display data and the sensed data in the related art.

In particular, as shown in FIG. 3, in the display period, a first transmitter TX1 of the timing controller TCON transmits video data VD to the source driver IC SDIC, through a high-speed serial interface according to the P2P transmission protocol. In the source driver IC SDIC, the video data which comprises a clock signal is received by a second receiver RX2, and clock and data recovery is performed with a clock and data recovery circuit CDR to obtain binary video data. The binary video data is then converted into an analog voltage value by a digital-to-analog converter DAC. The analog voltage value is amplified by an amplifier AMP, and transmitted to drive the display panel PNL. In the non-display period, the source driver IC SDIC senses conditions of the driving TFT in the display panel PNL, voltage values on the sense line SL are sampled by a sensor SMP, and the sampled analog voltage values are converted into binary digital voltage values by the analog-to-digital converter ADC. The binary digital voltage values are encoded by an encoder COD, and the encoded data are sent back to the timing controller TCON by a second transmitter TX2 through a MLVDS transmission protocol. A first receiver RX1 of the timing controller TCON receives the encoded data, and outputs a sensed data ADCD (ADC Data).

It is noted that in the driving device of the display panel in the related art, when the timing controller TCON transmits video data to the source driver IC SDIC, a lot of video data have to be transmitted. Namely, when the display data is sent to the display panel PNL, a lot of video data have to be transmitted, and thus the P2P transmission protocol is adopted. However, when the source driver IC SDIC sends the sensed data back to the timing controller TCON, data of reduced amount are required to be transmitted, and thus the MLVDS transmission protocol is adopted. In this kind of driving device, since two types of transmission protocols are adopted, the degree of system integration is low, the design is complicated, the stability is poor, and the cost is high.

To this end, embodiments of the present disclosure provide a driving device for a display panel, in which the design is simplified, the degree of system integration is increased, the stability is improved, and the cost is reduced.

Figure 4:
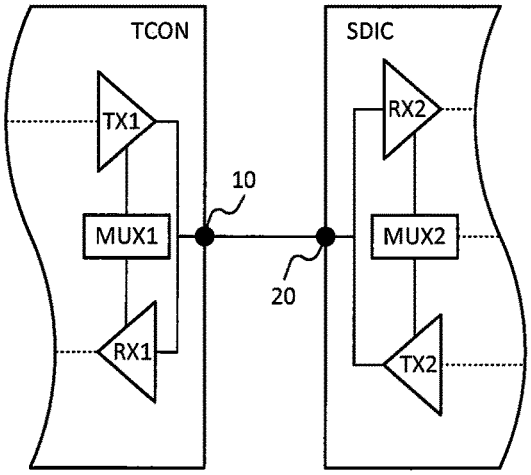
FIG. 4 is a structural diagram for a driving device for a display panel according to an embodiment of the present disclosure.

FIG. 4 is a block diagram of a driving device for the display panel according to an embodiment of the present disclosure.

In embodiments of the present disclosure, the display panel comprises organic light-emitting diodes (OLEDs). OLEDs can emit light by themselves, and have advantages suck as quick response, high light emitting efficiency, high brightness, and a wide viewing angle.

As shown in FIG. 4, in embodiments of the present disclosure, the driving device of the display panel comprises the timing controller TCON and the source driver IC SDIC.

The timing controller TCON comprises: a first interface 10; the first transmitter TX1 and the first receiver RX1 which are connected with the first interface 10; and a first data selector MUX1 which is configured to control the first transmitter TX1 and the first receiver RX1. The source driver IC SDIC comprises: a second interface 20 which is connected with the first interface 10; the second transmitter TX2 and the second receiver RX2 which are connected with the second interface 20; and a second data selector MUX2 which is configured to control the second transmitter TX2 and the second receiver RX2. The first data selector MUX1 and the second data selector MUX2 are configured to control the first transmitter TX1 to communicate with the second receiver RX2 in a first period, and to control the second transmitter TX2 to communicate with the first receiver RX1 in a second period.

In particular, in the driving device of the display panel according to embodiments of the present disclosure, one transmission line between the timing controller TCON and the source driver IC SDIC is omitted, and a respective data selector is added in the timing controller TCON and the source driver IC SDIC (i.e., the first data selector MUX1 and the second data selector MUX2) to select different periods. Thereby, the first data selector MUX1 and the second data selector MUX2 control data transmission between the timing controller TCON and the source driver IC SDIC in different periods. In exemplary embodiment, for example, the first period is the display period, and the second period is a the non-display period. In the first period, the first data selector MUX1 and the second data selector MUX2 control the first transmitter TX1 to communicate with the second receiver RX2, so that the timing controller TCON sends the control data to the source driver IC SDIC. For example, the control data comprises video data, a control signal and a clock recovery signal. In the second period, the first data selector MUX1 and the second data selector MUX2 control the second transmitter TX2 to communicate with the first receiver RX1, so that the source driver IC SDIC sends the sensed data to the timing controller TCON. In this way, the design is simplified, the degree of system integration is increased, the stability is improved, and the cost is reduced.

Figure 5:
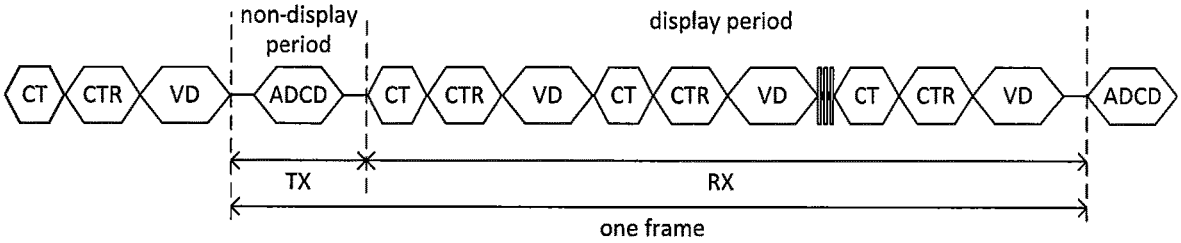
FIG. 5 is a timing diagram for P2P transmission according to an embodiment of the present disclosure.

In embodiments of the present disclosure, the first interface 10 and the second interface 20 are peer-to-peer P2P interfaces, and data transmission therebetween is performed through the P2P transmission protocol. A transmission timing of the P2P interface is shown in FIG. 5. Generally, the source driver IC SDIC acts as a transmitter TX in the non-display period, while acts as a receiver RX in the display period. CT indicates a clock training signal for recovering the clock signal of the source driver IC SDIC. CTR indicates the control signal. VD indicates video data. ADCD indicates the sensed data. Data transmitted in the first period (display period) are different from those in the second period (the non-display period). For example, the data transmitted in the first period transmission are the control data, while the data transmitted in the second period are the sensed data ADCD. The sensed data is transmitted through the P2P protocol, instead of the MLVDS protocol. Thus, transmission of the sensed data is subjected to reduced interference, the transmission speed is increased, and safety of transmission is improved.

Thus, in the driving device of the display panel according to embodiments of the present disclosure, the MLVDS transmission line is removed. In this way, the design is simplified, the degree of system integration is increased, the stability is improved, and the cost is reduced. By transmitting the sensed data through P2P, instead of MLVDS, transmission of the sensed data is subjected to reduced interference, the transmission speed is increased, and safety of transmission is improved.

The structure of the source driver IC SDIC will be described hereinafter with reference to FIG. 6.

Figure 6:
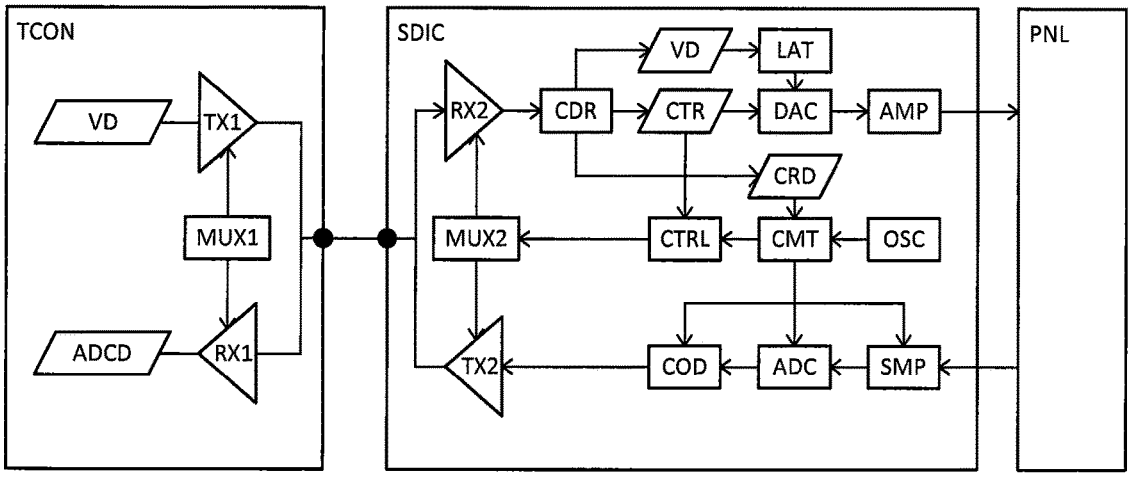
FIG. 6 is an internal structural diagram for a source driver IC according to an embodiment of the present disclosure.

As shown in FIG. 6, the source driver IC SDIC further comprises: the sensor SMP, the analog-to-digital converter ADC, and the encoder COD. The sensor SMP is configured to sense the sensed voltage value in the sense line SL. The analog-to-digital converter ADC is connected with the sensor SMP, and configured to convert the sensed analog voltage value into digital voltage value. The encoder COD is connected between the second transmitter TX2 and the analog-to-digital converter ADC, and configured to encode the digital voltage value.

As shown in FIG. 6, the source driver IC SDIC further comprises the clock and data recovery circuit CDR. The clock and data recovery circuit CDR is connected with the second receiver RX2, and is configured to recover the clock and data according to the clock recovery signal, so as to provide the video data VD, the control signal CTR, and the clock recovery signal CRD.

As shown in FIG. 6, the source driver IC SDIC further comprises a latch LAT. The latch LAT is connected with the clock and data recovery circuit CDR, and configured to drive the display panel PNL according to the video data VD.

As shown in FIG. 6, the source driver IC SDIC further comprises: the digital-to-analog converter DAC and the amplifier AMP. The digital-to-analog converter DAC is connected with the clock and data recovery circuit CDR, and configured to convert the control signal into an analog control signal. The amplifier AMP is connected with the digital-to-analog converter DAC, and configured to amplify the analog control signal.

In particular, in the first period, after the control data transmitted by the timing controller TCON through the P2P interface is received by the second receiver RX2, the clock and data recovery circuit CDR extracts the video data VD, the control signal CTR, and the clock recovery signal CRD from the control data. The video data VD is used for the display function of the display panel PNL. The control signal CTR is used to control the display of the display panel PNL. The data selection controller CTRL is connected with the clock and data recovery circuit CDR, and receives the control signal CTR, so as to control the second data selector MUX2, the second transmitter TX2 and the second receiver RX2. The clock and data recovery circuit CDR and the internal oscillator OSC form a clock management title CMT (Clock Management Title). The clock management title CMT provides the required clock source for the sensor SMP, the analog-to-digital converter ADC, and the encoder COD.

In the first period, the timing controller TCON transmits the control data to the source driver IC SDIC through high-speed serial interface P2P, the clock and data recovery circuit CDR of the source driver IC SDIC recovers the clock according to the clock recovery signal, so as to obtain the binary video data VD. The latch LAT caches the video data VD. The digital-to-analog converter DAC performs a digital-to-analog conversion on the video data VD which is stored in the latch LAT, according to the control signal CTR, so as to convert it into analog video data and output the analog video data to the amplifier AMP. The amplifier AMP amplifies the analog video signal, and outputs it to the display panel PNL to drive the display panel PNL.

In the second period, the sensor SMP of the source driver IC SDIC senses conditions of the driving TFT in the display panel PNL, and samples the sensed voltage value in the sense line SL. The sensed voltage value is converted into a sensed voltage digital value (binary digital value) by the analog-to-digital converter ADC. The sensed voltage digital value is encoded by the encoder COD to output the sensed data ADCD, and transmitted to the timing controller TCON through P2P.

It is noted that, after the source driver IC SDIC sends the sensed data back to the timing controller TCON, the timing controller TCON compensates the threshold voltage and mobility of the organic light-emitting diode OLED on basis of the sensed data according to algorithms.

In short, in the driving device of the display panel according to embodiments of the present disclosure, the first data selector and the second data selector are provided in the timing controller and the source driver IC, respectively, so that in the first period, the first data selector and the second data selector control the first transmitter to communicate with the second receiver, and in the second period, the first data selector and the second data selector control the second transmitter to communicate with the first receiver. Thus, in the driving device according to embodiments of the present disclosure, the design can be simplified, the degree of system integration can be increased, the stability can be improved, and the cost can be reduced.

Based on the above embodiments, the present disclosure further provides a display panel, which comprises the driving device of the display panel in any of the above embodiments.

In the display panel according to embodiments of the present disclosure, due to adoption of the above driving device, the design can be simplified, the degree of system integration can be increased, the stability can be improved, and the cost can be reduced.

In the present disclosure, description with reference to the terms "an embodiment", "some embodiments", "an example", "a specific example", or "some examples" indicates that specific features, structures, materials or characters which are described with reference to the embodiment or example are comprised by at least one embodiment or example of the present disclosure. In the present disclosure, expressions for the above terms are not necessarily directed to the same embodiments or examples. In addition, the specific features, structures, materials or characters as described can be combined in any suitable manner in any one or plurality of embodiments or examples. In addition, different embodiments or examples can be combined or features in different embodiments or examples can be combined in any way as long as no conflict is caused.

In addition, the terms "first", "second" or the like are for the purpose of describing, and shall not be construed to indicate or imply relative importance or implicitly indicate the number of the referred feature. Thus, the feature prefixed with "first", "second" or the like can explicitly or implicitly comprise at least one said feature. Unless otherwise defined, the term "a plurality of" means at least two, for example, two, three, or the like.

Apparently, a person with ordinary skill in the art can make various modifications and variations to the present disclosure without departing from the spirit and the scope of the present disclosure. In this way, provided that these modifications and variations of the present disclosure belong to the scopes of the claims of the present disclosure and the equivalent technologies thereof, the present disclosure also intends to encompass these modifications and variations.

What is claimed is:

1. A driving device for a display panel, comprising:

a timing controller; and a source driver integrated circuit (IC), wherein the timing controller comprises a first interface, a first transmitter, and a first receiver which are connected with the first interface, and a first data selector which is configured to control the first transmitter and the first receiver, wherein the source driver IC comprises a second interface which is connected with the first interface, a second transmitter and a second receiver which are connected with the second interface, and a second data selector which is configured to control the second transmitter and the second receiver, and wherein the first data selector and the second data selector are configured to control the first transmitter to communicate with the second receiver in a first period, and to control the second transmitter to communicate with the first receiver in a second period, wherein the first transmitter of the timing controller is configured to send control data to the second receiver of the source driver IC in the first period, and the second transmitter of the source driver IC is configured to send sensed data to the first receiver of the timing controller in the second period, wherein the control data comprises video data, a control signal, and a clock recovery signal, wherein the source driver IC further comprises:

a clock and data recovery circuit which is connected with the second receiver, and configured to extract the video data, the control signal and the clock recovery signal from the control data, a digital-to-analog converter which is connected with the clock and data recovery circuit, and configured to convert the control signal into analog control signal, an amplifier which is connected with the digital-to-analog converter, and configured to amplify the analog control signal, a sensor which is configured to sense a sensed voltage value in a sense line of the display panel, an analog-to-digital converter which is connected with the sensor and configured to convert the sensed voltage value into a sensed voltage digital value, an encoder which is connected between the second transmitter and the analog-to-digital converter, and configured to encode the sensed voltage digital value, an oscillator, wherein the oscillator and the clock and data recovery circuit form a clock management title, which is configured to provide a clock source to the sensor, the analog-to-digital converter and the encoder, and a data selection controller, which is connected with the clock and data recovery circuit and the clock management title, and configured to receive the control signal to control the second data selector, the second transmitter, and the second receiver.

2. The driving device of claim 1, wherein the first interface and the second interface are a peer-to-peer interface.

3. The driving device of claim 1, wherein the source driver IC further comprises:

a latch which is connected with the clock and data recovery circuit, and configured to cache the video data and drive the display panel according to the video data.

4. The driving device of claim 1, wherein the display panel comprises organic light-emitting diodes.

5. The driving device of claim 1, wherein the first period is a display period of the display panel, and the second period is a non-display period.

6. The driving device of claim 1, wherein the display panel is integrated with the driving device.

* * * * *